US006686531B1

(12) United States Patent
Pennock et al.

(10) Patent No.: US 6,686,531 B1
(45) Date of Patent: Feb. 3, 2004

(54) MUSIC DELIVERY, CONTROL AND INTEGRATION

(75) Inventors: James D. Pennock, Salt Lake City, UT (US); Robin M. Urry, Draper, UT (US)

(73) Assignee: Harmon International Industries Incorporated, Northridge, CA (US)

( * ) Notice: Subject to any disclaimer, the term of this patent is extended or adjusted under 35 U.S.C. 154(b) by 31 days.

(21) Appl. No.: 10/034,128

(22) Filed: Dec. 27, 2001

Related U.S. Application Data

(60) Provisional application No. 60/259,113, filed on Dec. 29, 2000.

(51) Int. Cl.[7] ..... G10H 1/18; G10H 7/00
(52) U.S. Cl. ..... 84/615; 84/612
(58) Field of Search ..... 84/609, 612, 615

(56) References Cited

U.S. PATENT DOCUMENTS 6,084,168 A * 7/2000 Sitrick ..... 84/477 R
6,348,648 B1 * 2/2002 Connick, Jr. ..... 84/477 R
6,423,893 B1 * 7/2002 Sung et al. ..... 84/645
2003/0046333 A1 * 3/2003 Jarman et al.

* cited by examiner

*Primary Examiner*—Jeffrey Donels
(74) *Attorney, Agent, or Firm*—Brinks Hofer Gilson & Lione

(57) ABSTRACT

This invention provides a system capable of delivering recorded music pieces to users and empowering the users with control features allowing for customization of the music. Recorded music pieces may be stored and recalled when selected by a user. Each musical piece may include one or more music modules corresponding to one or more musical instruments of The piece. Through a selection menu, the user may select one or more of the modules for inclusion in a customized version of The selected recorded music piece. The user may further adjust the pitch and/or tempo of the musical piece. Once customized by the user, the recorded musical piece may be integrated with sounds created by the user performing a selected musical instrument or instruments. The user may also select predefined special effect setup information module(s) that may be loaded into the signal processor capable of emulating the sonic characteristics of the recording of the recorded music piece. This integrated sound may thus mimic the original recorded music piece.

25 Claims, 2 Drawing Sheets

MUSIC DELIVERY, CONTROL AND INTEGRATION

CROSS REFERENCE TO RELATED APPLICATIONS

This application claims the benefit of U.S. Provisional Application Ser. No. 60/259,113 entitled "Method and System for Delivering and Controlling Recorded Music" filed on Dec. 29, 2000 and incorporated by reference.

BACKGROUND OF THE APPLICATION

1. Field of the Invention

This invention relates to systems for controlling the delivery of recorded music where the music may be customized and individual instruments may be isolated or selected by the user.

2. Related Art

A common methodology of learning to play a particular musical instrument or to emulate its performance in a recorded piece of music is to play along with the recorded piece of music attempting to replicate the performance of the particular instrument as closely as possible. To facilitate this process, it is often desirable to single out the particular instrument for a user to follow. Especially in the early stages of learning a new piece of music, it is desirable for the user to hear both the instrument that is being emulated and their own instrument along with the remaining instruments of the recording. As the user becomes more proficient at the particular piece of music, hearing the instrument in the music (that is being emulated by his own performance of his own instrument) may then become a distraction or hindrance to the learning process. At this stage it may be preferable to hear only the user's own instrument and the accompanying instruments of the recording, while excluding the instrument in the music that the user is trying to emulate or to learn.

Various users may desire to learn different instruments played in a particular piece of music, and hence, there is a need for a custom mixed version of the music with each instrument being selectively removed or included at the user's choice. Another desirable feature users may want during the learning process is for the tempo of the recorded music to be changed to a slower rate without changing the pitch of the music. This feature may be especially desirable when the user is unfamiliar with the flow of the music. As the user becomes more proficient, it may then be desirable to increase the tempo of the recorded music, Similarly, changing the pitch of the music without changing the tempo is another desirable manipulation, thereby allowing the music to be transposed into another key, for example. Changing the pitch further allows the music to be tuned to the instrument being played rather than requiring a re-tuning of the instrument to match the pitch of the recorded music.

Another aspect of learning to play a particular piece of music or instrument is the desirability for the user's own instrument to match the textural effect or sonic characteristics of the instrument in the recording, as generated during the recording process. Matching textural effects is particularly difficult with instruments such as the electric guitar or bass wherein extensive processing of the musical signal is common. It may thus be desirable for the user to have, for each instrument within the music if applicable, predefined musical special effect setup information that can be load into a musical effect processing device to emulate the signal processing that is done to match the textural effect or sonic characteristics of the initial music recording.

In addition, it may also be desirable for the user to have and select a copy or graphic representation of the written musical score pertaining to a desired instrument for the piece of music. In short, a need exists for improved systems capable of delivering recorded music and providing users with increased control functionality.

SUMMARY

This invention provides a system capable of delivering a customized copy of a recorded music piece with a plurality of control features. Users may select form a variety of recordings of musical pieces. Through a selection menu, the user may isolate one or more tracks for inclusion in a customized version of the selected recorded music piece. The user may also adjust the pitch or tempo of the selected track(s) or the entire musical piece.

The musical tracks may be selected for inclusion or exclusion from the desired musical piece. Omitted tracks may be supplemented by integration of music generated by a live performance of sound from instruments not found on the omitted track(s) For example, if a user wants to play a guitar, the guitar track can be omitted from a desired song and the user's guitar sounds integrated into a derivative work of the original song. Likewise, if a user desires to substitute the sounds of an electric piano for the guitar sounds, the guitar rack of a recorded song may be omitted and the sounds from the electric piano may be integrated to the derivative work of the original song.

In addition, the user may also select a predefined special effect thus modifying particular characteristics of a song. In this example, the user may load into the signal processing system information to emulate and match the sonic characteristics desired by the user. This integrated sound characteristic thus modifies the original recorded music piece according to the characteristic selected, e.g. increased or decreased pitch, etc. For example, if a user desired to hear a particular musical song at a higher pitch, the song would be generated and modified at the higher pitch. Likewise, if a user wanted to hear a particular song as through it were recorded in a canyon, the desired special effort would be selected by the user, and the generated song would be played as modified by the echoes of a canyon. The music score for the recorded music piece pertaining to any individual instrument contained in the recorded music piece may be displayed to the user in any user defined manner. A typically methodology to convey this information is in a computer generated graphic.

Recorded musical pieces may be recalled by a user via a communication link to a storage area accessible by a communication network such as a private network or a public network such as the Internet. The customizable copy of a recorded music piece is delivered from a repository to a local computer or a music processing system by Known communication interfaces. In another example, a repository of the recorded music pieces is stored on a data medium such as a CD-ROM from which the user can access any one of them using an access device such as a personal computer. The user can select individual instruments to be included in a customized copy of a selected recorded music piece. The user can also adjust the pitch variation and the tempo. The customized copy of the recorded music piece may be delivered to a playing device, and may also be integrated with sounds created by playing a user selected musical instrument through a musical effect signal processing device.

Other systems, methods, features and advantages of the invention will be or will become apparent to one with skill in the an upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention can be better understood with reference to the following figures. The components in the figures are not necessarily to scale, emphasis instead being placed upon illustrating the principles of the invention. Moreover, in the figures, like reference numerals designate corresponding parts throughout the different views

DESCRIPTION OF THE PREFERRED EMBODIMENT

This invention provides a system capable of delivering, controlling, and customizing the desired contents of a piece of recorded music. Control of the characteristics of the recorded music may involve, the selection of music content, e.g., which individual instruments are audible, the pitch and tempo of the music, and the selection of the musical score for each instrument within the recorded music. While not illustrated, it is understood that with the availability of communication network technologies such as the private networks and public networks such as the Internet, recorded music may be accessed and transmitted through the network to a user's personal computer or other electronic device. Various formats such as MP3 and subsequent derivatives are popular for transferring compressed music files. Thus, the availability of communication networks provides a convenient platform for downloading and modifying music pieces.

Figure 1:
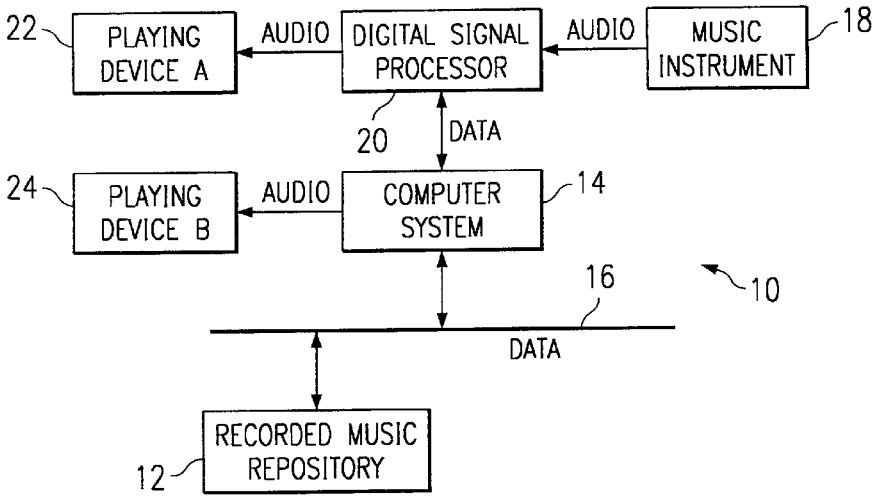
FIG. 1 is a block diagram illustrating an interactive music processing system.

In FIG. 1, the reference numeral 10 refers to a music system for downloading, controlling, and customizing a piece of recorded music in a manner that facilitates performance of a musical instrument. In one example, the system 10 includes a music repository 12 that contains a collection of recorded music pieces, each of which is downloadable to a computer system 14 through a communication link 16. The computer system 14 may be remotely located from the repository 12 and that the communication link may be, but is not limited to, a communications network such as the Internet.

The computer system 14 is typically controlled by a user or users (not shown). While not shown it is understood that the computer system may comprise a personal computer that includes a processor, memory, input/output devices, a display, and other well-known components and features. A signal processing device such as a digital signal processor 20 may be connected to the computer system 14. At least one musical instrument 18 may be coupled to the signal processing device 20. The computer system 14 may, at the user's choice, inform the signal processing device 20 special effect setup information to simulate sonic characteristics of a similar musical instrument originally contained in the recorded music piece.

In each recorded music piece in the music repository 12, the musical piece is recorded using separate tracks for the various instruments or vocals. The musical content played by an instrument, for example, may be isolated from that made by other instruments in the same piece of recorded music. Therefore, any (or a particularly selected) musical instrument contained in the recorded music can be excluded by the user's request before or after downloading the recorded music provided that the isolated instrument(s) are on a separate track.

For example, a loudspeaker system 22 may be connected to the signal processing device 20 and have no connection to the computer System 14. A guitar amplifier with its own speakers broadcasts the sound of a guitar, while the downloaded recorded music is broadcasted through the computer system 14 and its own playing device 24 such as Another set of speakers. However, the playing devices A and B (playing devices 22 and 24) may be components of the same device, such as an earphone with both the computer system 14 and the digital signal processor 20 connected. Therefore, the sound created by playing the musical instrument 18 and the sound of the downloaded recorded music piece are integrated in one playing device. The link between the recorded music repository 12 and the computer system 14 and further to the digital signal processor 20 is a communication link for transporting data such as a music file or control information such as the special effect setup information. On the other hand, the link from the musical instrument 18 to the digital signal processor 20, and further to the playing device A 22, may be a link transporting audio signals. Similarly, the link between the computer system 14 and its own playing device B transports audio signals.

Figure 2:
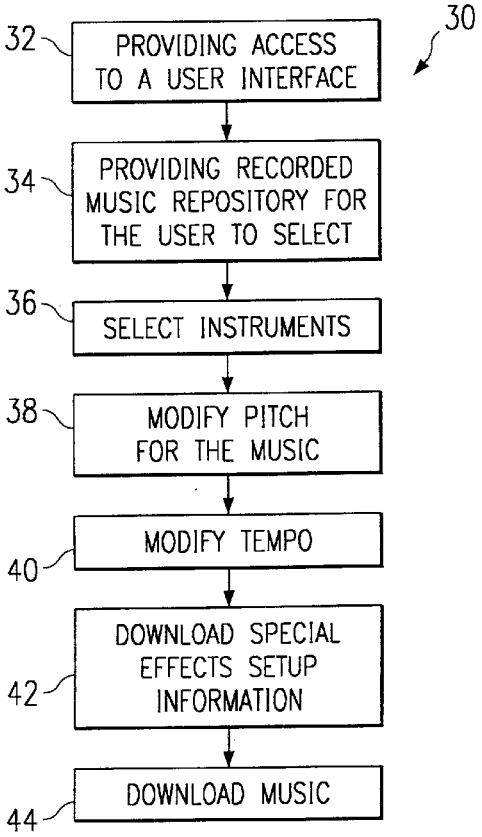
FIG. 2 is a block flow diagram illustrating an access and customization process for recorded music.

In another example, a web interface may be created for allowing a user to access various recorded music pieces to obtain a customized copy or version of a selected piece. In FIG. 2, a block flow diagram illustrates a service provider 30 providing recorded music to a user for use. Access is granted to a user 32 for the services provided by the service provider through a user interface such as a web page for registration and login. Once the user has logged in, a list of available recorded music pieces are provided for selection to the user 34. These listed music pieces have at least one common feature that allows certain instruments to be recorded on separate tracks. These separate tracks allow for the isolation of certain musical instruments or vocals. When the user has selected a particular music piece, the user is then prompted to select one or more music modules or track corresponding to one or more musical instruments so that the music contents created by such selected instruments are included the customized copy of the selected music piece 36. The user Is also allowed to manipulate the pitch 38 of The recorded music in the customized copy. Further in step 40, the user can modify tempo of selected music piece for the customized copy. In step 42, special effect setup information for programming the signal processing device can be obtained. While all the above selections are made, the user can start downloading a customized copy of the selected music piece to a local computer 44 such as the computer system 14 (FIG. 1). It is understood that steps 36, 38, 40, and 42 can be executed in any order After the user makes a selection for instruments to be downloaded in the customized copy of the selected music piece, the music score for the instrument that he is going to play along with the customized copy can be shown on the interface shown on his computer system. In order to bring up the music score for the right instrument, the user can select the playing of a particular instrument, or can tacitly indicate such an instrument by selecting all other instruments in the selected music piece to be included in the customized copy.

Figure 3:
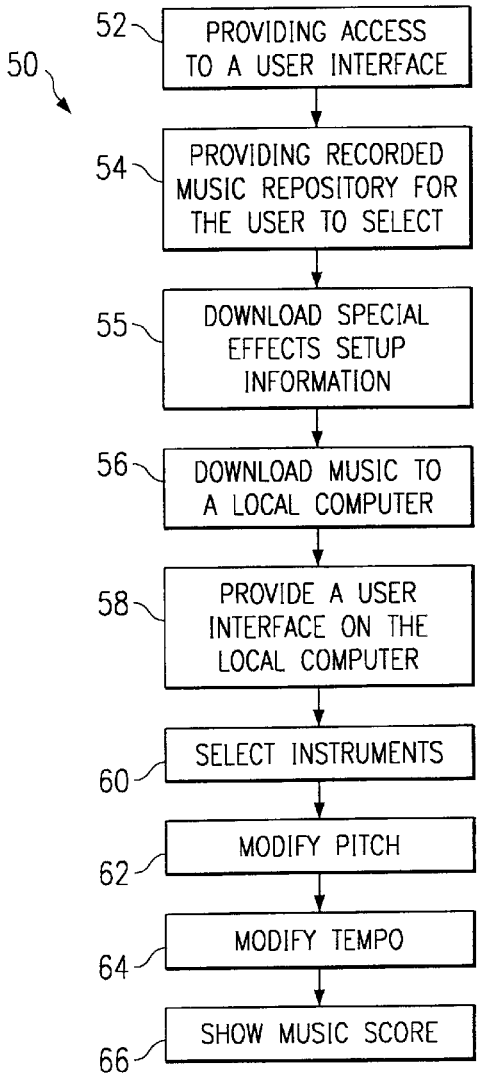
FIG. 3 is a block flow diagram illustrating an access and customization process for recorded music.

FIG. 3 is a flow diagram 50 illustrating a process for providing recorded music to a user by a service provider. In this example, the service provider allows the user to access its designated user interface (step 52), and shows a list of available music pieces to be downloaded (step 54). Special effect setup information can be downloaded in step 55 as well for programming the signal processing device 20 (FIG. 1). The selected music piece is then downloaded to an access device, such as a local computer system 14 of FIG. 1 (step 56). Once the downloading is complete, a composite music file (not shown) is stored in a local memory space of the local computer. The music file contains separable music modules for instruments included in the music piece. The user has the freedom to make all combinations of manipulatable features of the downloaded file with the assistance of software running on the local computer.

For example, when needed, the software creates another user interface (step 58) and allows the user to further select his instruments of preference (step 60), the pitch (step 62), and the tempo (step 64), or special effect setup information which is sent to the signal processing device. The music score of an indicated instrument may be shown on the local computer in step 66 so that the user can look at it while playing a user selected instrument. This allows the user to manipulate a file in his computer system without going to the service provider to download a new file every time a change is desired to be made to The dowloadable copy.

Figure 4:
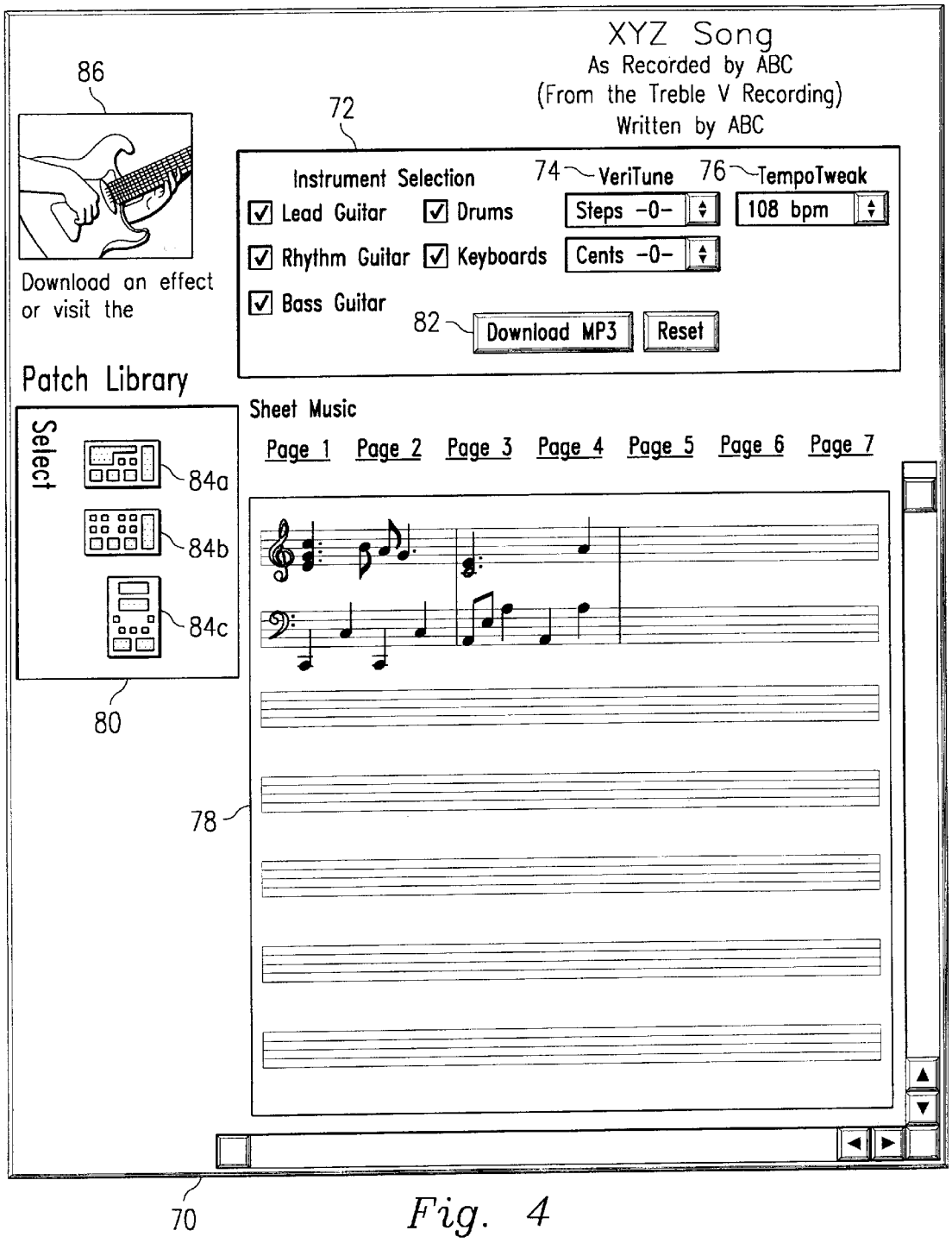
FIG. 4 is a graphical user interface facilitating the access, customization, and downloading of a recorded piece of music.

FIG. 4 illustrates an interactive user interface screen 70 provided by the service provider according to one example. The screen 70 may be provided on the display of the computer system 14, for example. If the Internet is chosen to be the transport means for delivering the music, this interactive user interface screen may be accessed by any permitted user through the Internet using web browser software. In some examples, the screen 70 may be provided by software on the local computer at the user's location. Referring to the screen 70, various control features may be provided that include interfaces for instrument selection 72, pitch manipulation 74, tempo manipulation 76, music score display 78, aid special effect setup information download 80.

For example, under the section labeled as "Instrument Selection" 72, the instruments in the desired music piece are listed, and the user has the freedom to choose any one or any combination of them to be included in the downloaded copy. For example, in one case, the instruments are lead guitar, rhythm guitar, bass guitar, drums, and keyboards. There is also a section labeled as "VeriTune™" 74 that allows for interactive selection of pitch manipulation of the delivered music. The user selects the number of steps (whole tones) and the number of cents (1/100 whole tones) to modify the pitch of the delivered music. Both the steps and cents can be selected via a pull-down menu showing the available ranges for each parameter. Also included is a section 76 that allows for interactive adjustment of tempo (under "TempoTweak™") for the delivered music. Similarly, the user can adjust the desired tempo, in beats per minute, of the delivered music via a pull-down menu showing the available tempo selections. Hence, via a computer input device (not shown) such as a mouse or keyboard, the user can interactively create an individualized customized variation of the recorded music by selecting and de-selecting desired individual instruments, desired tempo, and the amount of pitch modification. Once the selections are made, the user can download the customized copy of the selected recorded music piece by activating an icon such as the "Download MP3" button 82 in FIG. 4, resulting in a delivery of the copy to the user. Also shown next to the Download MP3 button is a "Reset" button, which, when it is activated, will return the tempo and pitch to the original values as well as include all instruments for the music as they exist in the recorded music.

Under the section shown as "Patch Library" 80, special effect setup information modules 84*a–c* are shown as a list of icons depicting signal processing devices to help reproducing sound effects or sonic characteristics of the downloaded music for the signal processing device. This section is designed to provide an interactive selection of special effects for selected musical instruments. The available modules change as the user changes the instrument that he is going to play (in this case, as indicated by section 86 in the upper left comer of the interface screen 70). Each of the modules as shown is capable of enabling a digital processing device to produce a desired special sound effect or sonic characteristics for the user's instrument performed in accompaniment with the customized copy of the recorded music to match the textural sound of the original recording. For instance, the user may simply select one of the icons, download the corresponding module (including the desired setup information) to the local computer 14, and further send it to the signal processing device via a MIDI connection when the user initiates 4 process to feed the special effect setup information to the signal processing device. If the signal processing device has no MIDI connection to the local computer 14, then the settings for the device are shown in a window on the local computer to be entered manually into the signal processing device.

The display section for the musical score 78 also changes based on the user's selection of particular instrument within the recorded music. For example, when the user plays a guitar along with other instruments in the recorded music piece, the music score for the guitar is shown on the display section. In addition, the display section may have icons for each page of the sheet music allowing the user to freely turn to each page of the music piece as needed.

The system 10 thus enables the use and customization of different recorded music pieces by allowing many aspects of the recorded music to be manipulated. These files may be combined in one single downloadable file to the local computer system, compressed for ease of downloading, and can be run together or separately by the local computer system 14.

One or more of the elements/steps of this invention may be implemented using software executed on a general purpose computer system 14, networked computer systems using special purpose hardware-based computer systems, or using combinations of special purpose hardware and software. For example, instead of downloading any file, all the recorded music pieces can be stored on a data medium such as hard drives (removable an and/or fixed), CD-ROMs, DVDs and/or derivative memory devices and physically delivered To an access device such as the local/personal computer of the user. The access device may further comprise any type of device in which a recording may be stored, and used alone or in combination with other equipment to access the recording. Certain software operable with the recorded music pieces may produce user interfaces similar to those illustrated in this invention for facilitating the user's customization of the recorded music. Additionally, this invention applies to any type of musical instrument, including the human voice.

In summary, an interactive control system enabling delivery, modification and control over various aspects of a piece of recorded music is provided by this invention. Control features may be implemented and made available to the user. Other controls over tempo and pitch allow the user to have an alterable customized control of the recorded music. Setup information may be loaded into a signal processing device in order to match the user's instrument being played to the sonic characteristics of the same instrument on the recording. The user's accompaniment may be integrated into the customized recording for playback and further control or processing.

The system provides an individual user with interactive control over the instrument content of the recorded music delivered to the user for a performance. The individual user may also have interactive control over the tempo, with or without pitch change, of a recorded music piece. Alternatively, the user may also interactively control the pitch, with or without a Tempo change. The user may also select predetermined setup information for various signal processing instruments thus matching the textural sounds or sonic characteristics if selected instruments contained in the recorded music. The user also is provided with the option to deliver and display selected music scores.

While various embodiments of the application have been described, it will be apparent to those of ordinary skill in the art that many more embodiments and implementations are possible within the scope of this invention. Accordingly, the invention is not to be restricted except in light of the attached claims and their equivalents.

What is claimed is:

1. A method for modifying recorded music comprising the steps of:

selecting a recorded music piece comprising at least one individually recorded music track played by a musical instrument;

selecting from a musical instrument selection menu at least one of the individually recorded music tracks to omit from the recorded music piece thereby specifying a customized version of the recorded music piece; and delivering the customized version of the recorded music piece to a user.

2. The method of claim 1 further comprising the step of selecting a pitch adjustment for the customized version of the recorded music piece.

3. The method of claim 1, further comprising the step of selecting a tempo adjustment for the customized version of the recorded music piece.

4. The method of claim 1 where the step of selecting an individually recorded music track comprises the step of omitting a selected track and a selected musical instrument playing the selected track in the recorded music piece.

5. The method of claim 4 further comprising the step of selecting special effect setup information modules comprising setup information for programming a signal processor to simulate a sonic characteristic of the selected musical instrument playing on the selected track.

6. A method for modifying recorded music comprising the steps of:

providing a recorded music repository comprising a plurality of recorded music pieces each comprising at least one individually recorded music tracks played by a musical instrument;

obtaining a piece selection specifying a selected recorded music piece chosen from the plurality of recorded music pieces;

obtaining an instrument selection specifying a selected musical instrument to omit from the selected recorded music piece;

providing a customized version of the selected recorded music piece that omits the selected musical instrument by omitting an individually recorded music track played by the selected music instrument.

7. The method of claim 6 further comprising the steps of obtaining a pitch selection and responsively adjusting the pitch of the customized version of the selected recorded music piece.

8. The method of claim 6 further comprising the step of obtaining an effect selection specifying a special effect setup information modules comprising setup information for a programming a signal processor to simulate a sonic characteristic of the selected musical instrument.

9. A method for modifying recorded music comprising the steps of:

storing separate recorded music tracks Played by individual instruments, the separate recorded music tracks comprising a musical piece;

obtaining track selection input that identifies each separate recorded music track as one of an included recorded music track and an omitted recorded music track;

preparing a customized musical piece that includes each of the included recorded music tracks and that excludes each of the omitted recorded music tracks;

obtaining a control input that identifies a special effect to apply to the customized musical piece;

applying the special effect to the customized musical piece to obtain a modified customized musical piece; and delivering the modified customized musical piece.

10. The method of claim 9 further comprising the step of displaying a musical score for at least one of the omitted recorded music tracks.

11. The method of claim 9 further comprising the steps of:

displaying a signal processing device library comprising a plurality of musical instrument signal processor indicia;

obtaining a setup information module selection specifying a signal processor represented by at least one of the signal processor indicia; and delivering setup information for setting up the signal processor to simulate a sonic characteristic of at least one of the individual instruments that played at least one of the omitted recorded music tracks.

12. A music modification system, comprising:

a memory storing a recorded music piece comprising individually recorded, music tracks played by individual musical instruments;

a user interface supported by the music modification system, the user interface including:

a track selection section for selecting at least one of the individually recorded music tracks to omit from the recorded music piece to specify a customized version of the recorded music piece; and a delivery selection input for initiating delivery of the customized version of the recorded music piece.

13. The system of claim 12 where the user interface further comprises a Ditch selection input for specifying a Ditch modification applied to the customized version of the recorded music piece.

14. The system of claim 12 where the user interface further comprises a tempo selection input for specifying a temp modification applied to the customized version of the recorded music piece.

15. The system of claim 12 where the user interface further comprises a special effect selection section comprising a plurality of musical instrument signal processor indicia for obtaining input selecting a signal processor and associated setup information for setting up the signal processor to simulate a sonic characteristic of at least one of the musical instruments that Played at least one of the omitted recorded musical tracks.

16. A music modification system, comprising:

a repository comprising a plurality of recorded music pieces, each comprising a plurality of individually recorded music tracks played by individual musical instruments;

a user access device for providing access to the repository, selecting a recorded music piece, and selecting at least one of the musical instruments to omit from a customized copy of the selected recorded music piece; and a transport interface for delivering the customized copy of the selected recorded music piece to a user.

17. The system of claim 16 further comprising a pitch adjustment device.

18. The system of claim 16 further comprising a tempo adjustment device.

19. The system of claim 16 further comprising an instrument selection input.

20. The system of claim 16 further comprising a database comprising a plurality of special effect setup information modules, each comprising setup information for setting up a pre-determined signal processor to simulate a sonic characteristic of at least one of the musical instruments that played at least one of the omitted recorded musical tracks.

21. A method for learning to play a musical instrument, the method comprising the steps of:

accessing a recorded music repository storing a recorded music piece as a plurality of separately recorded tracks, the tracks individually played by pre-determined musical instruments;

choosing from the pre-determined musical instruments a selected musical instrument to omit from the music piece;

receiving a customized music piece from the repository, the customized music piece including each separately recorded track except that played by the selected musical instrument; and playing the musical instrument in accompaniment with the customized music piece.

22. The method of claim 21, further comprising the step of receiving a musical score for the selected instrument for the music piece.

23. The method of claim 21, further comprising the steps of:

selecting from the repository a special effect setup information module for a signal processor connected to the musical instrument being played;

receiving the special effect setup information module from the repository; and setting up the signal processor in accordance with the special effect setup information so that he signal processor simulates a sonic characteristic of the selected musical instrument omitted from the customized music piece.

24. The method of claim 21, further comprising the step of:

selecting a pitch adjustment for the customized music piece, and where the step of receiving additionally comprises receiving the customized music piece adjusted by the pitch adjustment.

25. The method of claim 21, further comprising the step of:

selecting a tempo adjustment for the customized music piece, and where the step of receiving additionally comprises receiving the customized music piece adjusted by the tempo adjustment.

* * * * *

UNITED STATES PATENT AND TRADEMARK OFFICE

CERTIFICATE OF CORRECTION

PATENT NO. : 6,686,531 B1
DATED : February 3, 2004
INVENTOR(S) : James D. Pennock et al.

It is certified that error appears in the above-identified patent and that said Letters Patent is hereby corrected as shown below:

Title page,
Item [57], ABSTRACT,
Line 7, after "instruments of" delete "The" and substitute -- the -- in its place.
Line 9, after "version of" delete "The" and substitue -- the -- in its place.

Column 7,
Line 60, after "music" delete "tracks" and substitute -- track -- in its place.

Column 8,
Line 16, after "music tracks" delete "Played" and substitute -- played -- in its place.
Lines 60-61, delete "Ditch" and substitute -- pitch -- in its place (both occurrences).

Column 9,
Line 7, after "instruments that" delete "Played" and substitute -- played -- in its place.

Column 10,
Line 21, after "so that" delete "he" and substitute -- the -- in its place.

Signed and Sealed this

Twenty-second Day of February, 2005

JON W. DUDAS
*Director of the United States Patent and Trademark Office*